United States Patent [19]

Bossons

[11] 3,976,237

[45] Aug. 24, 1976

[54] WEB GUIDE SYSTEMS

[75] Inventor: Walter Howard Bossons, Almondsbury, England

[73] Assignee: Masson Scott Thrissell Engineering Limited, Bristol, England

[22] Filed: Mar. 11, 1974

[21] Appl. No.: 450,082

[30] Foreign Application Priority Data

Mar. 9, 1973 United Kingdom ..... 11557/73

[52] U.S. Cl. ..... 226/97; 83/98; 226/172

[51] Int. Cl.[2] ..... B65H 17/32

[58] Field of Search ..... 226/7, 91, 97, 172; 83/98

[56] References Cited

UNITED STATES PATENTS

| | | | |
|---|---|---|---|
| 3,143,016 | 8/1964 | Obenshain | 226/97 X |
| 3,192,845 | 7/1965 | Schmidt | 226/97 X |
| 3,265,267 | 8/1966 | Wallin | 226/91 |
| 3,273,775 | 9/1966 | Cook | 83/98 X |
| 3,549,070 | 12/1970 | Frost | 226/97 |
| 3,622,058 | 11/1971 | Vits | 226/7 |
| 3,705,676 | 12/1972 | Overly | 226/97 |
| 3,711,960 | 1/1973 | Overly | 226/97 X |

*Primary Examiner*—Richard A. Schacher
*Attorney, Agent, or Firm*—Young & Thompson

[57] ABSTRACT

The threading of the leading end of a fresh web of sheet material through apparatus for cutting or performing other operations on it is assisted by fluid entrainment. Air jets are arranged at gaps between conveyors and roller nips and are directed to support and guide the leading end. Use can be made of the Bernouilli effect, with jets arranged on one side only of the web path.

9 Claims, 6 Drawing Figures

WEB GUIDE SYSTEMS

This invention relates to web guide systems.

It is a well known problem, when processing lengths of material, such as paper and paper-board for example, through a cutting machine that the leading edge of the web has to be threaded through a multitude of rollers, cutter blades and conveyors. This is a time consuming and awkward operation and can be dangerous. The "down-time" of a machine which has to be so threaded may make it as little as 50 per cent efficient.

There are known systems for splicing the tail end of one web as it runs out to the leading end of a new web. This can be done in various ways, either with the leading end of the new web spliced to the old web a short distance from the trailing end or with a similar overlapping splice but with the trailing end part beyond the splice cut off. The webs may also be butted together at trailing and leading ends and taped across the join. However, all these methods require the machine speed to be run down unless accumulator devices are provided to store up web lengths while allowing the machine to continue to run at speed. Furthermore, the splice or tape joints can cause trouble when they are eventually fed through the machine. The problem of initial threading is not solved by this of course, and although there have long been means such as Sheahan rope intakes for pulling a new web through sets of rollers as in a paper making machine, the general problem of threading into a cutting or winding machine has not been resolved.

Mechanical self-threading is known, for example in film projectors, but there the sprocket driven leader tape is sufficiently stiff for the leading end portion to maintain a given attitude and direction even though temporarily unsupported. Also, it does not run at a very fast speed when being threaded through the projector. A web of paper several feet wide and of much flimsier construction is a very different matter.

It would therefore be desirable to find some means for speedily threading a new or replacement flexible web through a machine without the necessity of that web being attached to a preceding web or some other draw means to take it through, or of having its leading end stiffened.

If self-threading can be achieved, apart from the obvious advantages noted above it will be possible to allow a previous web to run out at full speed without slowing the machine down. The speed of the machine when the new web is entered will then depend on the accelerating means provided for the new web.

The invention may be performed in various ways, and some constructional forms will now be described, by way of example, with reference to the accompanying drawings, in which.

Figure 1:
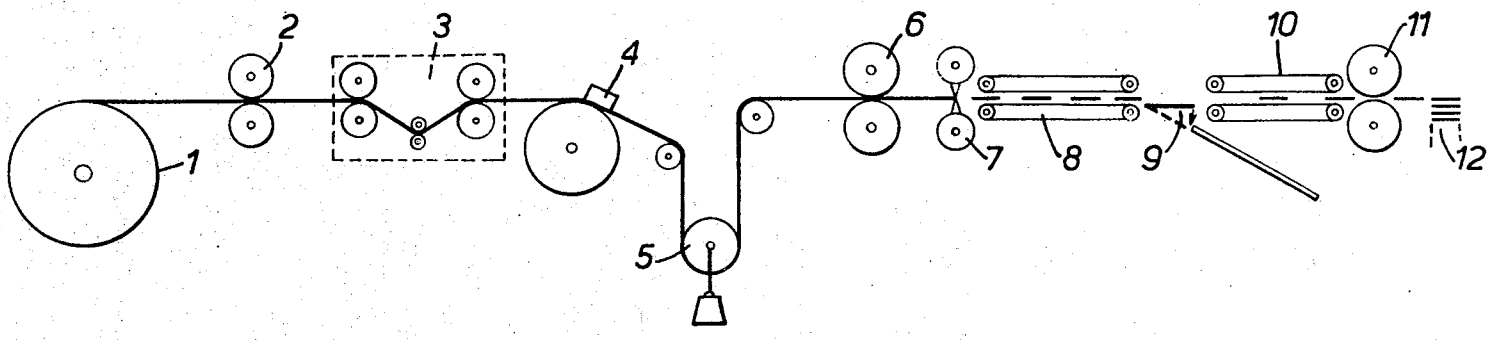
FIG. 1 is a diagram of a cutter and ancillary equipment for reels of paper.

In FIG. 1 a reel 1 of paper is unwound through a pair of primary draw rolls 2, a curl corrector device 3, an inspection device 4, a tension control system 5, a pair of feed rollers 6 and cutter rollers 7 and then transported in sheets via a primary conveyor 8, a diverter 9 for imperfect sheets, a secondary conveyor 10 and stacking rolls 11, to a layboy 12. Some of these items are optional, but it will be understood that at least the rolls 6 and cutters 7 are essential and some conveying means upstream and downstream of these. When all the items are present, as they should be for the production of good quality sheets of uniform size and shape, there will be a large number of rolls through which to feed the web upstream of the cutter rollers 7.

Figure 2:
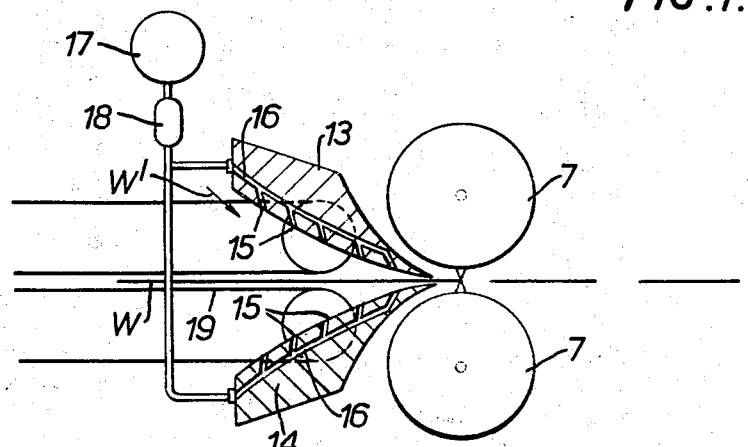
FIG. 2 is a diagrammatic side view of a pair of cutter rollers with air guide means according to the invention.

Referring to FIG. 2, an air entrainment device is shown in association with the cutter rollers 7. This consists of two curved members 13, 14 above and below the web path W and arranged to converge towards the nip of the cutter rollers. Air jets issue from the surfaces of these members through inclined orifices 15 directed towards the web path W and slanted in the direction of travel of the web. Not all the inclinations need be the same and neither are the jets required to be uniformly spaced in the direction of web travel. The jets may be more concentrated towards the nip. One convenient way of forming the orifices 15 and their common delivery channels 16 is to form each member 13, 14 as a side-by-side stack of wedge-like elements with the faces to be butted together grooved in the pattern of the orifices and channels. When stacked or laminated together, the grooves will form ducting.

In other form, the members 13, 14 may simply be apertured plates, equivalent to the facing surfaces shown, with air jet nozzles mounted behind the plates and arranged to direct jets through the apertures at angles equivalent to the inclined orifices 15.

The pressure air is obtained from a compressor 17 or an air bottle (not shown) and is directed through an ionising device 18 before delivery to the channels 16. This can help counteract the electrostatic charges that can build up on paper webs and cause them to adhere to roller surfaces.

The leading end of a web of paper may be conveyed to this device by conventional conveyor means, indicated at 19, which cannot reach right into the nip. The device "takes over" the leading end and carries it forward in the central equilibrium zone created by the jets.

Figure 3:
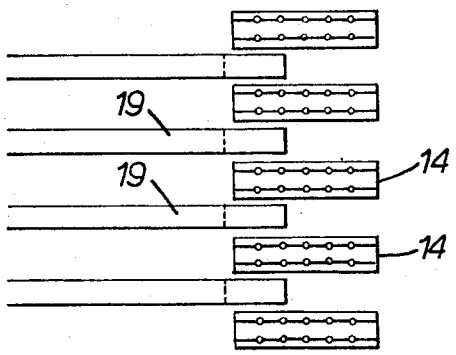
FIG. 3 is a plan view of part of the conveying apparatus using air guide means together with suction tapes according to the invention.

Referring to FIG. 3 there is shown the transition between a conveyor 19 of conventional form using suction tapes with entrainment devices 13, 14 as of FIG. 2. This figure also illustrates the laminated construction of members 13, 14 referred to above. The suction tapes are inter-digitated with air entrainment devices across the width of the cutter, and as the web leaves the suction tapes the entrainment devices will take over the leading end support without interruption. Such means also allows the air to vent away between the devices. When the threading up process is complete the leading and guiding devices 13, 14 may be withdrawn as required to assist the free passage of the web and avoid surface damage.

Figure 4A:
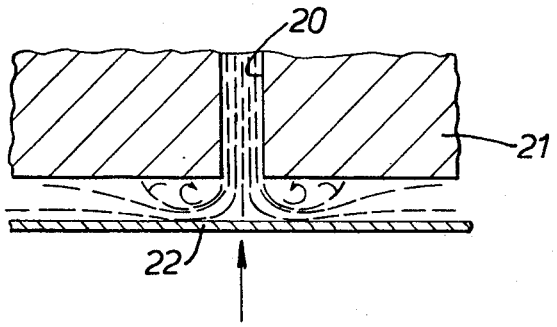
FIG. 4 is a diagram and graph for illustrating the Bernouilli effect.
Figure 4B:
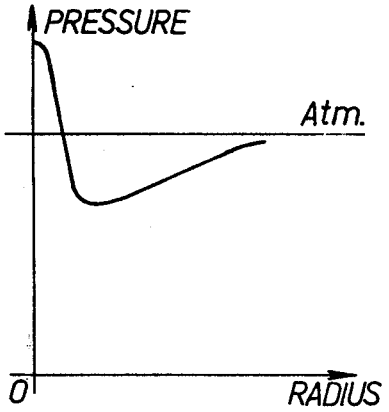

As an alternative to having two opposed sets of air jets with an equilibrium zone between them, use may be made of the Bernouilli effect and a single set of air jets. Referring to FIG. 4, (a) illustrates an orifice 20 for pressure air issuing perpendicularly from a flat under surface of a member 21. A sheet 22, of paper for example, is held parallel with this surface a short distance below it. (b) illustrates the different forces on the sheet for different distances, in terms of pressure against radius from the orifice, atmospheric pressure being indicated by the horizontal line. When lying against the surface there is a maximum force on the sheet away from the surface, which rapidly decreases with distance until the vortex bubble around the orifice mouth generates a pressure negative with respect to atmospheric. Thus the resultant force on the sheet becomes upwards rather than downwards by the time the negative peak is reached. The sheet can therefore be held in equilibrium at an intermediate point. Beyond a certain distance the vortex effect dies away and the nett force will again be downwards.

This effect is only appreciable over a limited area, but the jets can be multiplied as indicated above to create a substantial equilibrium zone. The air must be given an opportunity to escape, however, and therefore the number of jets from a particular member, if they are not arranged solely linearly as along a bar for example, must be limited. The arrangement of FIG. 3, for instance, would provide sufficient air escape routes for the number of orifices illustrated.

Figure 5:
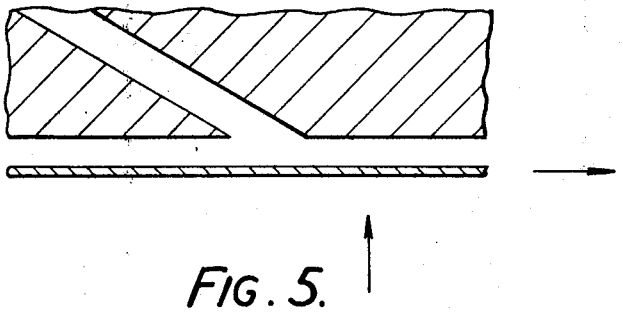
FIG. 5 is a diagram for illustrating an angled air jet orifice.

The effect is also obtainable from an inclined orifice, as shown in FIG. 5. In addition, there will be a viscous drag on the sheet in the direction in which the orifice points. While this will not be sufficient to pull a whole web of paper, it will maintain the flimsy, unsupported leading end pointing in the desired direction.

The principle is also applicable to guiding webs in other than straight paths between rollers. It can also be used to change the web direction. For example, the leading end of a web might arrive from the direction W′ in FIG. 3, but by the effect described above, it will be guided around member 13 and into the nip of the cutters. The Bernouilli effect is used to support a web by means of air directed downwardly and creating a reduced pressure zone to overcome gravity. It will be appreciated that webs or sheets can be supported by air jets directed upwardly, but the equilibrium position will be at a different distance from the surface from which the jets issue.

It will be understood that all roller pairs and any other machine parts likely to hinder the free passage of the web in such apparatus can be equipped with these air entrainment devices. Such devices can also be used to direct the individual sheets of paper downstream of the cutters.

It will also be understood that other materials than paper and paper substitutes can use these devices, such as thin plastic film, fabric or metal foil.

I claim:

1. In a paper or paperboard cutting machine, means for guiding the leading end of at least one web of paper or paperboard into the cutting zone, the guiding means comprising an opposed set of fluid entrainment devices, each set consisting of a plurality of air jet members spaced apart across the width of the intended web path and the air jets being directed towards said path and into the cutting zone, and conveyor bands whose delivery ends alternate with and overlap the air jet members.

2. Guiding means according to claim 1, wherein each said air set member has a smooth surface from which the air jets issue.

3. Guiding means according to claim 1, wherein said air jets are non-evenly distributed.

4. Guiding means as claimed in claim 1, wherein the angles and/or orientation of at least some of the jets to the web path differ.

5. A paper or paperboard cutting machine including means for guiding the leading end of at least one web of paper or paperboard into the cutting zone, according to claim 1, and further fluid entrainment devices for directing such webs through other parts of the machine.

6. A machine according to claim 5, wherein the further entrainment devices act on one side only of the webs.

7. A machine according to claim 6, wherein the further entrainment devices include air jets arranged in relation to the web path to support and direct the web by the Bernouilli effect.

8. A machine according to claim 5, and further comprising an ionising device through which fluid for the entrainment devices is passed.

9. A machine as claimed in claim 5, including means for rendering inoperative or removing the entrainment devices once the web leading end has passed.

* * * * *